US008621809B2

(12) United States Patent
Ivarsson

(10) Patent No.: US 8,621,809 B2
(45) Date of Patent: Jan. 7, 2014

(54) WALL FRAMING SYSTEM

(71) Applicant: Lindab Innovation AB, Bastad (SE)

(72) Inventor: Niclas Ivarsson, Bastad (SE)

(73) Assignee: Lindab Innovation AB, Bastad (SE)

( * ) Notice: Subject to any disclaimer, the term of this patent is extended or adjusted under 35 U.S.C. 154(b) by 0 days.

(21) Appl. No.: 13/803,190

(22) Filed: Mar. 14, 2013

(65) Prior Publication Data

US 2013/0232908 A1 Sep. 12, 2013

Related U.S. Application Data

(63) Continuation of application No. 12/597,228, filed as application No. PCT/EP2007/063133 on Dec. 3, 2007, now Pat. No. 8,448,395.

(30) Foreign Application Priority Data

Apr. 23, 2007 (DK) ..... 200700592

(51) Int. Cl.

| | |
|---|---|
| ***E04C 2/34*** | (2006.01) |
| ***E04C 3/02*** | (2006.01) |
| ***E04C 3/30*** | (2006.01) |
| ***E04H 1/00*** | (2006.01) |
| ***E04H 12/00*** | (2006.01) |

(52) U.S. Cl.
USPC ..... 52/481.1; 52/243; 52/696

(58) Field of Classification Search
USPC ..... 52/696, 715, 481.1, 241, 243
See application file for complete search history.

(56) References Cited

U.S. PATENT DOCUMENTS

| | | | | |
|---|---|---|---|---|
| 3,536,345 | A | 10/1970 | Leifer | |
| 3,831,333 | A | 8/1974 | Nelsson et al. | |
| 3,839,839 | A | 10/1974 | Tillisch et al. | |
| 4,936,067 | A | 6/1990 | Menchetti | |
| 5,218,803 | A | 6/1993 | Wright | |
| 5,274,973 | A | 1/1994 | Liang | |
| 5,313,752 | A * | 5/1994 | Hatzinikolas | 52/243 |

(Continued)

FOREIGN PATENT DOCUMENTS

| | | |
|---|---|---|
| CA | 2293091 A1 | 6/2001 |
| DE | 3231487 A1 | 3/1984 |

(Continued)

OTHER PUBLICATIONS

International Search Report and Written Opinion of the International Searching Authority. International application No. PCT/EP2007/063133. Date of the actual completion of the international search: Mar. 13, 2009.

(Continued)

*Primary Examiner* — Andrew Triggs
(74) *Attorney, Agent, or Firm* — Mollborn Patents, Inc.; Fredrik Molborn

(57) ABSTRACT

A wall framing system includes a channel member having two opposite side walls and a stud having two opposite side walls and at least one locking member. The locking member is integrally formed with the stud and is arranged, when the stud has been located at a desired position in the channel member between the side walls thereof, to be bent into a locking position in which the locking member exerts outwardly directed forces on the side walls of the stud thereby achieving a frictional engagement between the stud and the channel member.

14 Claims, 3 Drawing Sheets

(56) References Cited

U.S. PATENT DOCUMENTS

| | | | | |
|---|---|---|---|---|
| 5,325,651 | A * | 7/1994 | Meyer et al. | 52/715 |
| 5,394,665 | A * | 3/1995 | Johnson | 52/241 |
| 6,176,053 | B1 * | 1/2001 | St. Germain | 52/232 |
| 6,647,691 | B2 * | 11/2003 | Becker et al. | 52/656.1 |
| 6,843,035 | B1 * | 1/2005 | Glynn | 52/573.1 |
| 6,983,569 | B1 | 1/2006 | Rosenberg | |
| 7,797,901 | B2 * | 9/2010 | Near | 52/481.1 |
| 8,448,395 | B2 * | 5/2013 | Ivarsson | 52/210 |
| 2007/0033884 | A1 | 2/2007 | Wright | |
| 2010/0126106 | A1 * | 5/2010 | Ivarsson | 52/696 |

FOREIGN PATENT DOCUMENTS

| | | | |
|---|---|---|---|
| EP | 1726729 | A1 | 11/2006 |
| EP | 1731687 | A2 | 12/2006 |
| WO | 0014355 | A1 | 3/2000 |

OTHER PUBLICATIONS

PCT International Preliminary Report on Patentability. International application No. PCT/EP2007/063133. Date of completion of this report: Aug. 3, 2009.

* cited by examiner

WALL FRAMING SYSTEM

CROSS-REFERENCE TO RELATED APPLICATIONS

This application is a continuation of U.S. patent application Ser. No. 12/597,228, filed on 19 Jan. 2010, and entitled "Wall Framing System," which is a national phase application of PCT Application No. PCT/EP2007/063133, filed on 3 Dec. 2007, and entitled "Wall Framing System," which application claims priority from Danish Application No. PA200700592, filed on 23 Apr. 2007. The content of these applications are incorporated herein by reference.

BACKGROUND

The various embodiments of the invention generally relate to wall framing systems, stud members for use in wall framing systems, methods for assembling a wall framing system, methods for manufacturing a stud member for a wall framing system, and methods for joining stud members into a length-adjustable stud member.

To build up a framing system for walls in buildings, it is desirable to have a wall framing system which is easy to assemble and has adequate positioning means to provide a certain relative positioning of separate members forming part of the framing system.

A wall framing system comprises channel members to be fastened to a wall, a floor, a ceiling or to configure a border to for example a door opening or a window opening or the like. The framing system further comprises stud members, which stud members are to be placed between the channel members in either a vertical manner or a horizontal manner.

It is well known to secure or fasten the individual stud members to the channel members using screws, nails, rivets or the like to assemble such a wall framing system. Such connection methods are often troublesome and require special tools, such as electric screw-drivers, drills or riveting machines etc.

It is known from U.S. Pat. No. 6,983,569 to have flaps arranged opposite in the side portions or in the floor portion of the channel member, said flaps being positioned in groups or along the channel member at specified distances to each other so that it is possible to place a stud member in a channel member in such a way that the outer sides of the side walls of the stud member come into contact with the inner sides of the side walls of the channel member, the side walls of the stud member resting against the opposite flaps or the flaps fitting into corresponding apertures whereby the stud member is secured to the channel member in at least one direction relative to the longitudinal direction of the channel member. To secure the stud member from moving in other directions relative to the channel member, flaps arranged in predetermined distances are provided in the channel member. When bending these flaps and thereby preventing the movement of the stud in a direction away from the flaps, the stud member is secured in the channel member. The disadvantage of such a system is that the stud member can be placed only at predetermined locations in the channel member.

From U.S. Pat. No. 5,325,651 is known a wall frame structure where a clip bracket is provided to hold plates (channel member) and studs (stud member) together at a predetermined location.

The clip bracket is provided with tongues for insertion through an open top or bottom of an impression adjacent the inner face of the respective wall. The tongues are ganged together by a bridging arm for simultaneous insertion of a pair of through the openings in a confronting pair of impressions.

Using the wall frame system according to U.S. Pat. No. 5,325,651 also entails that the stud member can be placed only at predetermined locations in the channel member, the locations being where the impressions of the channel member are positioned in apertures in the stud member and locked by the clip bracket.

U.S. Pat. No. 3,536,345 describes a channel member where the side walls are resilient and the upper parts of the side walls are bent inwardly to provide an access opening of less width than the width of the stud member (studs). Each of the sidewalls is provided at selected intervals with stud receiving pockets comprising inwardly punched protrusions or lugs.

SUMMARY

The various embodiments of the invention provide a stepless and flexible way to fasten a stud to a channel member, as well as an improved arrangement for connecting a wall framing system. As a result, the use of fastening means such as screws, nails, rivets or the like, which are time consuming to use, can be eliminated.

In general, in one aspect, various embodiments of the invention provide a wall framing system that includes a channel member having two opposite side walls and a stud having two opposite side walls and at least one locking member. The locking member is integrally formed with the stud and is arranged, when the stud has been located at a desired position in the channel member between the side walls thereof, to be bent into a locking position in which the locking member exerts outwardly directed forces on the side walls of the stud thereby achieving a frictional engagement between the stud and the channel member.

Embodiments of the invention can include one or more of the following features. The locking member, when being bent into the locking position, can leave an opening in the stud in which opening the locking member is initially located. The opening can be a knock-out or punched-out opening formed in the stud during the manufacture thereof. The locking member can be in the form of a flap attached to the stud along a bending edge at the opening. The stud can include a base connecting the two opposite side walls of the stud, and the opening can be formed in the base of the stud.

The locking member can be arranged to be bent from an initial position to the locking position in a geometrical pending plane, where the outwardly directed forces are directed substantially perpendicular to the geometrical bending plane. The locking member can be arranged to be bent from an initial position to said locking position in a direction towards the channel member. The at least one locking member can be arranged at an associated end of the stud and can be arranged to be bent in a direction towards the associated end of the stud. The at least one locking member can include more than one locking member.

The at least one locking member can include a first locking member being arranged to lock an associated first end of the stud in relation to the channel member, and a second locking member being arranged to lock an associated second end of the stud in relation to another channel member or another stud. The at least one locking member can be arranged, when positioned in said locking position, to exert said outwardly directed forces substantially perpendicular to inner sides of the side walls of the stud. The stud can be a metal stud. The side walls of the stud can be provided with flanges extending towards each other. The locking member, when in its locking position, can exert the outwardly directed forces on the flanges. The flanges can be arranged on edges of the side walls of the stud.

The various embodiments can provide one or more of the following advantages. The erection time of a wall framing system can be reduced considerably. Further there is no need for tools to assemble the wall framing system, since use of fasteners such as screws, nails, rivets or the like are eliminated. Having flanges can result in a more rigid stud, and ensure a high moment and thereby a greater force and friction. Having knock-out openings allows the stud to be delivered in standard lengths and subsequently be cut into a needed length, still having locking means to engage with the stud and fix the stud in the channel member at a desired position. Placing a knock out opening in the channel member provides a further support to the positioning of the stud in the channel member, if needed. The stud can be positioned and locked in any position in the channel member in a flexible and handy way.

DESCRIPTION OF THE DRAWINGS

In the following, the various embodiments of the invention will be described with reference to the figures, which shows non-limiting embodiments and variants, an in which.

DETAILED DESCRIPTION

Figure 1:
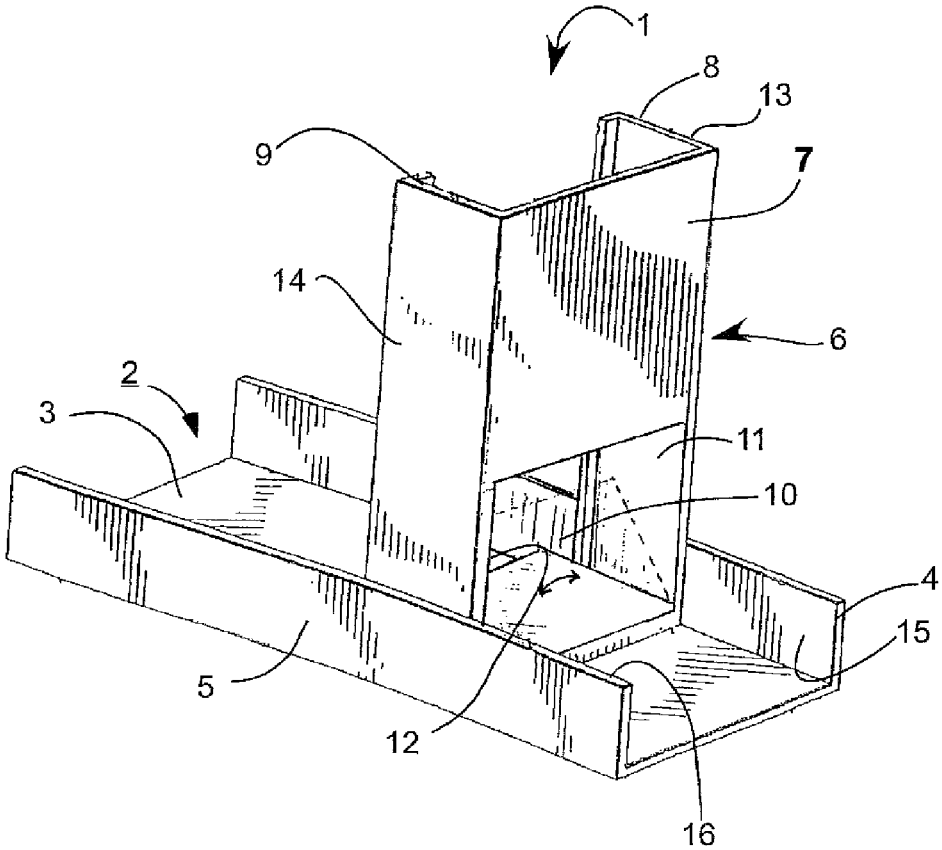
FIG. 1 shows a wall framing system according to an embodiment of the invention.

FIG. 1 shows a wall framing system 1 according to an embodiment of the invention. The wall framing system 1 comprises a channel member 2 with a floor portion 3 and a pair of side walls 4, 5 upstanding from said floor portion 3, a stud member 6 also having a floor portion 7 and a pair of side walls 8, 9 upstanding from said floor portion 7 for interconnection with said channel member 2, the stud member 6 being insertable between said side walls 4, 5 of the channel member 2. For obtaining a reliable and secure fixation of the stud member 6 in the channel member 2, the wall framing system 1 further comprises locking means 10 for fixating the stud member 6 to the channel member 2.

Such locking means 10 can be made up of one or more plate members 10 attached to the stud member 6.

In the embodiment shown in FIG. 1, the locking member 10 is fixed to the floor portion 7 of the stud member 6 such that, when placing the locking means, i.e. the plate member 10 in its locking position, it is exerting a force substantially perpendicular to an inner side 11, 12 of the side walls 8, 9 of the stud 6, and thereby provides an outer side 13, 14 of the side walls 8, 9 exerting a force substantially perpendicular to an inner side 15, 16 of the side walls 4, 5 of the channel member 2, thus fixating the stud 6 relative to the channel member 2.

In other embodiments the locking means 10 can be placed in or on the inner side 11, 12 of the side walls 8, 9. When brought into locking position, the locking members 10 press against each other or press against the floor portion 7 exerting a force substantially perpendicular to the inner side 11, 12 of the side walls 8, 9 of the stud 6, and thereby provide the outer side 13, 14 of the side walls 8, 9 exerting a force substantially perpendicular to the inner side 15, 16 of the side walls 4, 5 of the channel member 2, placing the stud 6 in a fixed position relative to the channel member 2.

Figure 4:
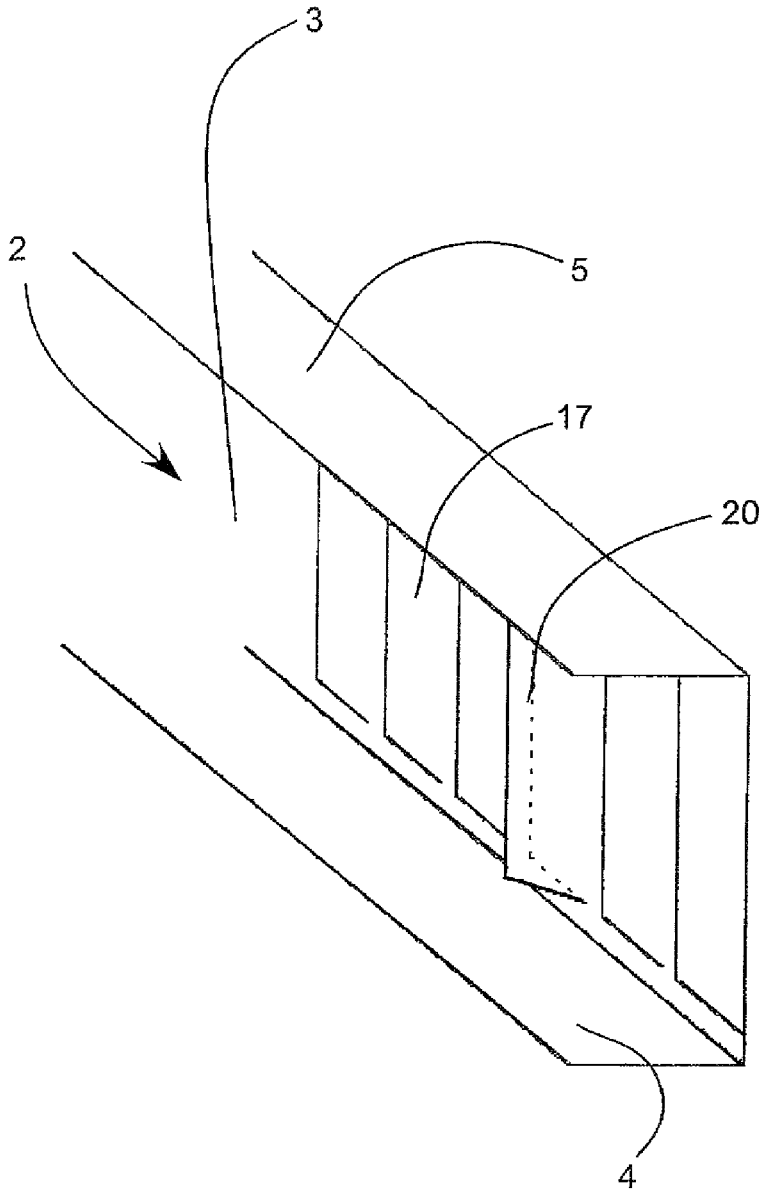
FIG. 4 shows an embodiment having locking means provided on the channel member.

In FIG. 4 is shown a further embodiment of the invention where the channel member 2 is provided with knock-out openings 17, which knock-out openings 17 are to be used as an aid for positioning the stud member 6 in the channel member 2.

A knock-out opening 17 can be explained as an opening where three in four sides of a flap are cut or punched out or nearly cut or punched out in such a way that the flap can be bent over the side of the flap still connected to the surface from which the knock out opening is made.

In a certain embodiment of this solution, the knock-out openings 17 are situated in the floor portion 3 of the channel member 2. Such a knock-out opening 17 can also engage with the side walls 8, 9 of the stud member 6, when a stud member 6 is positioned close to the knock-out opening 17. Thereby the flap 20 from the knock-out opening 17 can act as locking means able to exert a force on the inner surface 11, 12 of the side walls 8, 9 of the stud member 6 such that, when the flap 20 from the knock-out opening 17 is engaged with the stud member 6, the outer surfaces 13, 14 of the side walls 8, 9 of the stud member 6 are pressed against the inner surfaces 15, 16 of the side walls 4, 5 of the channel member 2 thereby achieving a frictional engagement between the contacting surfaces of the stud member 6 and the channel member 2.

To achieve a more precise definition of the areas where forces are acting, the side walls 8, 9 of the stud member 6 can be provided with flanges 108, 109 extending from the side walls 8, 9 towards each other.

In a further embodiment, the flanges 108, 109 can be arranged on edges of the side walls to achieve a high moment.

The stud member 6 is preferably produced from a rigid material such as metal.

In an embodiment of the wall framing system, one or more locking members 10 is/are attached to the stud member 6.

In another embodiment, one or more locking members 10 is/are moveable between an un-locked position and a locked position, in which locked position the stud member 6 is fixated in the channel member 2.

Figure 3:
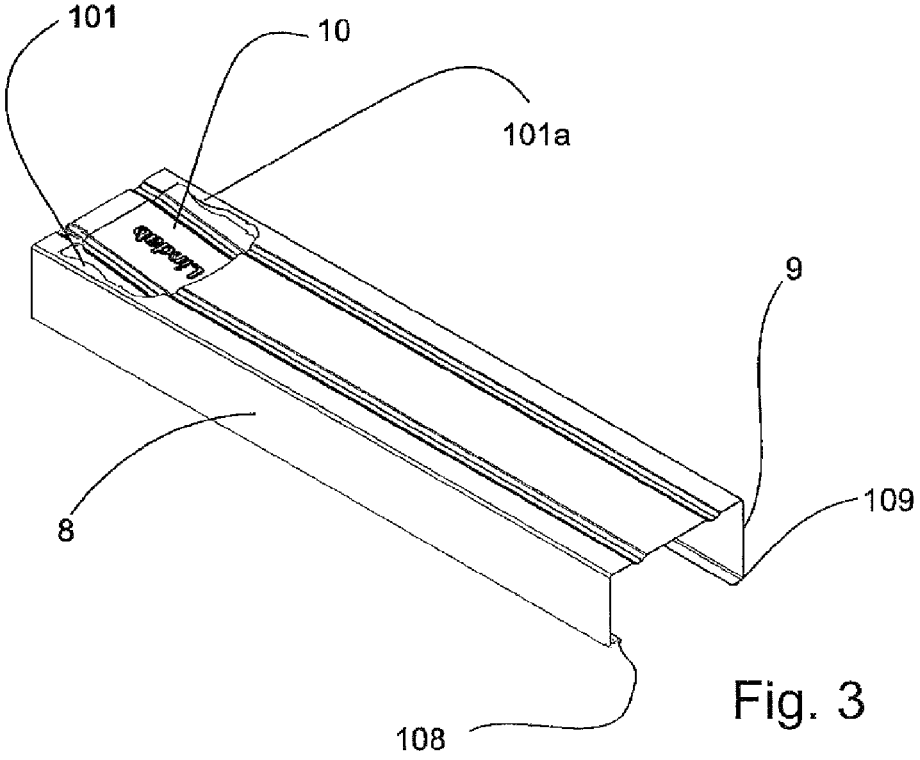

In a further embodiment of the stud member 6, as shown in FIG. 3, the locking member 10 is bent over an edge 102. When bending the locking member 10 into locking position, a pair of notches is formed (pre-cut). These notches corresponding to a pair of small projections 101, 101*a* form a kind of holding means for holding the locking member in locked position. The distance from the bending edge 102 to one projection 101 is different from the distance from the bending edge 102 to the other projection 101*a*. In this embodiment these particular distances correspond to different heights of the side walls 8, 9.

Figure 2:
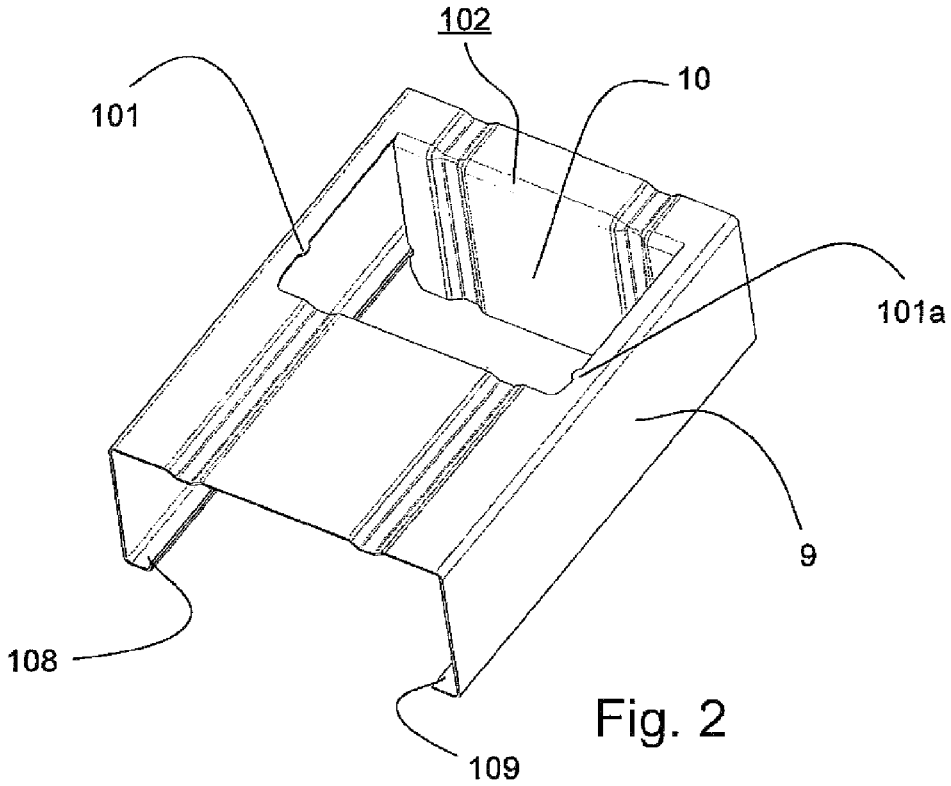
FIGS. 2 and 3 show different embodiments having locking means provided on the stud member.

Hereby the flanges 108, 109 can engage with the notches in the locking member to hold the locking member into the engaged position as shown in FIG. 2.

The features mentioned above can also be used in combination with a stud member for use in a framing system.

A method of assembling a wall framing system as described above, in accordance with one embodiment, comprises the steps of:

- Securing the channel member 2 to a building structure, such as a floor, a wall, a ceiling or the like;
- Arranging the stud member 6 between side walls 4, 5 of the channel member 2 in such a way that the side walls 8, 9 of the stud member 6 are substantially parallel to the side walls 4, 5 of the channel member 2;
- Fixating the stud member 6 in the channel member 2 by moving the locking member 10 from an un-locked position to a locked position, thereby achieving a frictional engagement between the contacting surfaces of the stud member 6 and the channel member 2.

In a further embodiment of method of assembling a wall framing system as described above, the method is carried out with following steps:

Securing the channel member 2 to a building structure, such as a floor, a wall, a ceiling or the like;

Arranging the stud member 6 between side walls 4, 5 of the channel member 2 in such a way, that the side walls 8, 9 of the stud member 6 are substantially in parallel with the side walls 4, 5 of the channel member 2;

Fixating the stud member 6 in the channel member 2 by moving the locking member 10 from an un-locked position to a locked position, thereby achieving a frictional engagement between the contacting surfaces of the stud member 6 and the channel member 2.

To manufacture elements for the wall framing system, a method of manufacturing locking members in stud members and a tool for manufacturing the locking members in stud members are provided.

The profiled stud member 6 is advanced through a tool, which tool is performing three operations at a time. The first operation punches out a flap forming a locking member 10 which is held in place by a bending edge 102 allowing the flap to be bent backwards and forwards in relation to its current position. To make the bending of the locking member 10 more easy, the punching out of the flap can leave a number of points along the bending line or a line with reduced thickness of material can form the bending line in such a way that it is possible to bend the locking member 10 in relation to the floor portion 7 of the stud member 6 and it still is possible to have the locking member attached to the stud member 6 along an edge 102 of the locking member 10.

The bending edge 102 produced by the first operation is placed in the direction of the flap 10 being most forward in the operational direction. The punch or the contact surface of the punch creating the flap 10 is positioned in an inclining position in relation to the floor portion 7 of the stud member 6. This inclined position leads to a reduced need for force to perform the punching. To prevent the flap 10 from being stuck in the punching form or die, a spring biased ejector or an ejector with resilient means is provided for bringing back the punching form or die to its original position and thereby positioning the flap 10 in a position aligned with the floor portion 7 of the stud member 6 in such a way that it is possible for the stud member 6 to pass through the rest of the parts of the tool without getting stuck.

Immediately after or during the last sequence of the first operation, the second operation is performed, the second operation being a cutting operation. In the cutting operation a narrow strip is cut or punched out from the stud member 6 to achieve a desired length of the stud member 6.

After cutting or punching out the strip from the stud member 6, the same operation as the first operation is repeated just with the difference that the parts of the tool are reversed or mirrored in relation to the tool carrying out the first operation in such a way that the bending edge 102 is placed on the opposite side of the flap 10 and the stud member 6. A punch from the tool cuts the profile of the stud member 6 and at the same time forms the flap or locking member 10 in the stud member 6 which is just cut free from the profile together with the flap or locking member 10 in the profile of the next stud member 6.

The tool is placed on a kind of slide able to be advanced together with, and at the same velocity as, the profile to be cut and punched. Hereby it is possible to cut and punch the stud member 6 and still continue the profiling of the stud member 6 without stopping the profiling process.

The tool is advanced by the slide at the same velocity as the profile until the process for manufacturing a stud member profile has ended. Then the slide will return to its starting point and there await a signal or impulse initiating the next cutting and punching cycle.

It is obvious that, when manufacturing the first end of the first profile in a series, only the locking member 10 in the first end will be formed together with a cut to determine the distance from the end of the stud member 6 to the locking member 10 formed in the one end of the member or profile 6. When forming the locking member 10 in the other end of the profile 6, the cutting in length of the profile 6 and forming of the locking member 10 in the one end of the next stud member 6 will be performed in the same operational sequence and at substantially the same time.

A further advantage of having a stud member 6 provided with one or more locking members 10 in the form of knock-out openings is a possibility to join two stud members 6 into a telescopic member.

Each stud member 6 is provided with flanges 108, 109 arranged on edges of the side walls 8, 9. By having one of the side walls 8 or 9 extending further from the floor portion 7 than the other sidewall 8 or 9, it is possible to insert two stud members 6 into each other.

FIG. 2 and FIG. 3 show an embodiment, where the side wall 9 extends further from the floor portion 7 than the side wall 8.

The one side wall 8 extends a distance corresponding in such a way that the outer dimension of the one side wall 8 of the stud member 6 measured from the outer side of the underside of the floor portion 7 to the outer side of the upper side of the flange 108 is equal to or smaller than the inner dimension of the other side wall 9 of the stud member measured from the inner side of the floor portion 7 to the inner side of the lower side of the flange 109.

In a further embodiment, the two stud members 6 are dimensioned to be able to "snap" into each other when joined into each other's open profile.

When two profiles are positioned in a joined state, it is possible to displace one stud member in relation to the other stud member in a longitudinal direction thereby achieving a telescopic action.

When the two stud members are displaced into a desired position corresponding to the desired length of a stud member, which usually could be the distance from the floor to the ceiling in a building, where a wall is to be put up, the locking members of the stud members can be activated by pressure by hand or a simple tool, i.e. a shaft from a hammer, a spirit level, a screwdriver or the like.

When the locking members of the overlapping parts of the two opposite positioned and joined stud members are activated, the length of the joined stud member is fixated and the joined stud member can be placed in an upper and a lower channel member as if the joined stud member is a single stud member with the correct length for positioning it in the two channel members.

Hereby is achieved that two shorter stud members can be joined to form a longer stud member which makes the system more flexible and therefore it is not necessary to produce and keep in stock too many different lengths of stud members to meet the needs of the market.

As an example two stud members each of 150 cm can be joined to a telescopic member which can cover lengths from approximately 170 cm to 280 cm.

In the same manner other suitable lengths can be used to cover any desired intervals of length i.e. between a floor and a ceiling.

What is claimed is:

1. A wall framing system, comprising:

a channel member having two opposite side walls connected by a base; and a stud presenting a longitudinal direction and having two opposite side walls, wherein said stud comprises at least one locking member, the locking member being integrally formed with the stud along a bending edge extending perpendicular to said longitudinal direction of the stud, wherein the locking member, when the stud has been located at a desired position in the channel member between the side walls of the channel member, is arranged to be bent along said bending edge in a direction towards said base of the channel member into a locking position, and wherein the locking member in said locking position exerts outwardly directed forces on both side walls of the stud thereby achieving a frictional engagement between the stud and the channel member.

2. A wall framing system as claimed in claim 1, wherein said locking member, when being bent into said locking position, leaves an opening in the stud in which opening the locking member is initially located.

3. A wall framing system as claimed in claim 2, wherein said opening is a knock-out or punched-out opening formed in the stud during the manufacture thereof.

4. A wall framing system as claimed in claim 2, wherein said locking member is in the form of a flap attached to the stud along said bending edge at said opening.

5. A wall framing system as claimed in claim 2, wherein the stud further comprises a base connecting the two opposite side walls of the stud, and wherein said opening is formed in the base of the stud.

6. A wall framing system as claimed in claim 1, wherein the locking member is arranged to be bent from an initial position to said locking position in a geometrical bending plane, and wherein said outwardly directed forces are directed substantially perpendicular to said geometrical bending plane.

7. A wall framing system as claimed in claim 1, wherein said at least one locking member is arranged at an associated end of the stud and is arranged to be bent in a direction towards the associated end of the stud.

8. A wall framing system as claimed in claim 1, wherein said at least one locking member comprises more than one locking member.

9. A wall framing system as claimed in claim 1, wherein said at least one locking member comprises a first locking member being arranged to lock an associated first end of the stud in relation to said channel member, and a second locking member being arranged to lock an associated second end of the stud in relation to another channel member or another stud.

10. A wall framing system as claimed in claim 1, wherein said at least one locking member being arranged, when positioned in said locking position, to exert said outwardly directed forces substantially perpendicular to inner sides of the side walls of the stud.

11. A wall framing system as claimed in claim 1, wherein the stud is a metal stud.

12. A wall framing system as claimed in claim 1, wherein the side walls of the stud are provided with flanges extending towards each other.

13. A wall framing system as claimed in claim 12, wherein said locking member, when in said locking position, exerts said outwardly directed forces on said flanges.

14. A wall framing system as claimed in claim 12, wherein the flanges are arranged on edges of the side walls of the stud.

* * * * *